US008608158B2

(12) United States Patent
Akimatsu et al.

(10) Patent No.: US 8,608,158 B2
(45) Date of Patent: Dec. 17, 2013

(54) SHEET FEEDING APPARATUS COMPRISING A SEPARATION ROLLER AND A PAD ASSEMBLY

(75) Inventors: Takayuki Akimatsu, Nagoya (JP); Masaru Takeuchi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/219,226

(22) Filed: Aug. 26, 2011

(65) Prior Publication Data

US 2012/0049438 A1 Mar. 1, 2012

(30) Foreign Application Priority Data

Aug. 27, 2010 (JP) ..... 2010-191011

(51) Int. Cl.
*B65H 3/52* (2006.01)

(52) U.S. Cl.
USPC ..... 271/124; 271/121

(58) Field of Classification Search
USPC ..... 271/124, 121
See application file for complete search history.

(56) References Cited

U.S. PATENT DOCUMENTS

| | | | | |
|---|---|---|---|---|
| 4,319,741 | A * | 3/1982 | Okamoto | 271/121 |
| 4,865,306 | A * | 9/1989 | Himegi | 271/124 |
| 6,318,716 | B1 | 11/2001 | Okuda | |
| 6,540,221 | B2 * | 4/2003 | Nakashima et al. | 271/124 |
| 6,948,710 | B2 | 9/2005 | Togashi et al. | |
| 7,497,432 | B2 | 3/2009 | Ikeda | |
| 2005/0200071 | A1 | 9/2005 | Ikeda | |
| 2007/0235919 | A1 * | 10/2007 | Kawamura | 271/124 |
| 2012/0043714 | A1 * | 2/2012 | Hamaguchi et al. | 271/10.09 |

FOREIGN PATENT DOCUMENTS

| | | | |
|---|---|---|---|
| JP | 1008147 | A | 1/1989 |
| JP | 02-064540 | | 5/1990 |
| JP | 6080266 | A | 3/1994 |
| JP | 08-133511 | A | 5/1996 |
| JP | 2000-191165 | A | 7/2000 |
| JP | 2000191165 | A * | 7/2000 |
| JP | 2005-060091 | A | 3/2005 |
| JP | 2005060091 | A * | 3/2005 |
| JP | 2005255385 | A | 9/2005 |

OTHER PUBLICATIONS

Non Final Office Action issued in related U.S. Appl. No. 13/070,591 dated Jan. 29, 2013.

(Continued)

*Primary Examiner* — Gerald McClain
(74) *Attorney, Agent, or Firm* — Banner & Witcoff, Ltd.

(57) ABSTRACT

A sheet feeding apparatus is provided, including a separation roller configured to apply a feeding force to a sheet, a pad assembly configured to pivot about a pivot axis in a direction close to or away from a supporting unit, and an elastic member configured to press the pad assembly toward the separation roller. The pad assembly includes a separation pad disposed facing the separation roller configured to apply a resistive force to a sheet, a holder holding the separation pad, and a first engaging portion disposed on a side of a distal end. The supporting unit includes a second engaging portion. The first and second engaging portions are configured to engage each other to restrict the pad assembly such that the distal end is not separated from the supporting unit more than a specified distance when the separation roller is separated from the separation pad.

14 Claims, 7 Drawing Sheets

(56) References Cited

OTHER PUBLICATIONS

Japanese Application No. 2010-191011—Decision of Final Rejection mailed Mar. 12, 2013.

Notice of Reasons for Rejection issued in corresponding Japanese Patent Application No. 2010-191011 dated Dec. 18, 2012.

First Office Action and Search Report issued in corresponding Chinese Application No. 201110247705 mailed Oct. 29, 2013.

* cited by examiner

SHEET FEEDING APPARATUS COMPRISING A SEPARATION ROLLER AND A PAD ASSEMBLY

CROSS REFERENCE TO RELATED APPLICATION

This application claims priority from Japanese Patent Application No. 2010-191011, filed on Aug. 27, 2010, the entire subject matter and contents of which are incorporated herein by reference.

TECHNICAL FIELD

Aspects of the invention relate to a sheet feeding apparatus configured to separate a sheet from a stack of sheets and to feed the sheet.

BACKGROUND

A known sheet feeding apparatus includes a separation roller disposed at one end side relative to a stack direction of sheets and a separation pad disposed at the other end side relative to the stack direction. The separation roller is configured to rotate in contact with a sheet at the one end side to apply a feeding force to the sheet. The separation pad is configured to contact a sheet at the other end side and apply a resistive force (friction resistance) to the sheet such that the sheet is not fed. In this manner, the sheet feeding apparatus is configured to feed a single sheet contacting the separation roller.

However, the sheet feeding apparatus uses an elastic member, such as a coil spring, to press the separation pad toward the separation roller. As such, when the separation roller is assembled to a supporting unit such as an upper cover, it may be necessary to assemble the separation roller to the supporting unit while manually pressing the separation pad toward the supporting unit such that the coil spring is compressed.

SUMMARY

Aspects of the present disclosure may provide a sheet feeding apparatus in which a separation roller is more conveniently assembled (e.g., inserted or attached). For example, assembly of the separation roller may be necessary for maintenance.

According to an aspect of the disclosure, a sheet feeding apparatus is configured to feed sheets, individually, stacked in a stack direction. The sheet feeding apparatus may include a separation roller, a pad assembly, and an elastic member. The separation roller is configured to rotate in contact with a sheet of the stacked sheets to apply a feeding force to the sheet. The pad assembly is configured to pivot about a pivot axis between a position close to a supporting unit and a position away from the supporting unit. In one example, the supporting unit is stationary relative to the separation roller. The pad assembly includes a separation pad, a holder, and a first engaging portion. The separation pad is disposed facing the separation roller and is configured to contact a sheet of the stacked sheets to apply a resistive force to the sheet. The holder holds the separation pad, and is pivotally attached to the supporting unit. The first engaging portion is disposed on a side of a distal end. The elastic member is configured to press the pad assembly toward the separation roller. Additionally, according to one or more arrangements, the supporting unit includes a second engaging portion. The first engaging portion and the second engaging portion are configured to engage each other to restrict the pad assembly such that the distal end is not separated from the supporting unit more than a specified distance when the separation roller is separated from the separation pad.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the invention will be described in detail with reference to the accompanying drawings. A sheet feeding apparatus according to illustrative aspects of the disclosure is applied to an automatic document feeder (ADF) mechanism of an image reading apparatus.

The general structure of an illustrative ADF mechanism 10 will be described with reference to FIG. 1.

Figure 1:
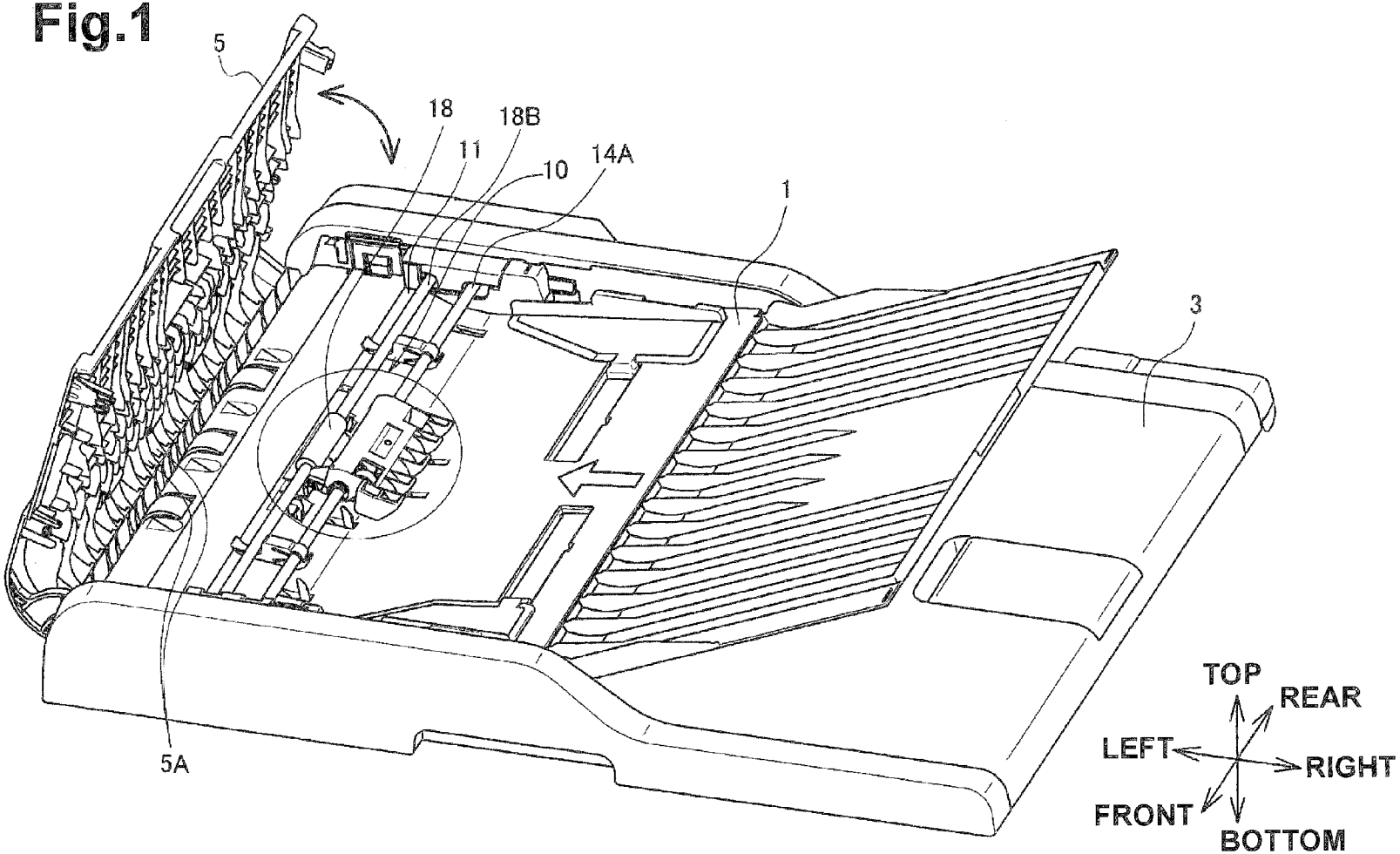
FIG. 1 is a perspective view of an example image reading apparatus in which a cover is open according to one or more aspects described herein.

As shown in FIG. 1, the ADF mechanism 10 is a device configured to successively and individually feed documents (e.g., a single sheet at a time) stacked in their thickness direction in a document tray 1, to a reading unit (not shown) in a direction of the illustrated arrow. A document read by the reading unit is subsequently ejected to an ejection tray 3. FIG. 1 illustrates cover 5 in an open position. However, when feeding documents, the ADF mechanism 10 is covered by the cover 5.

The cover 5 is pivotally attached to a supporting unit 11 where the document tray 1 is disposed. The cover 5 includes, on its inner wall surface, ribs 5A which extend in a document feeding direction when the cover 5 is closed.

During document feeding, ends of the ribs 5A contact and guide a document fed by the ADF mechanism 10. In a particular example, the cover 5 is configured to protect the ADF mechanism 10 and to define a part of a feeding path for a document fed by the ADF mechanism 10.

In the ADF mechanism 10 according to the embodiment, documents are received by the document tray 1 such that their thickness direction aligns with the vertical direction. The documents are then successively and individually fed to (or into) the reading unit starting from an uppermost document.

Figure 2:
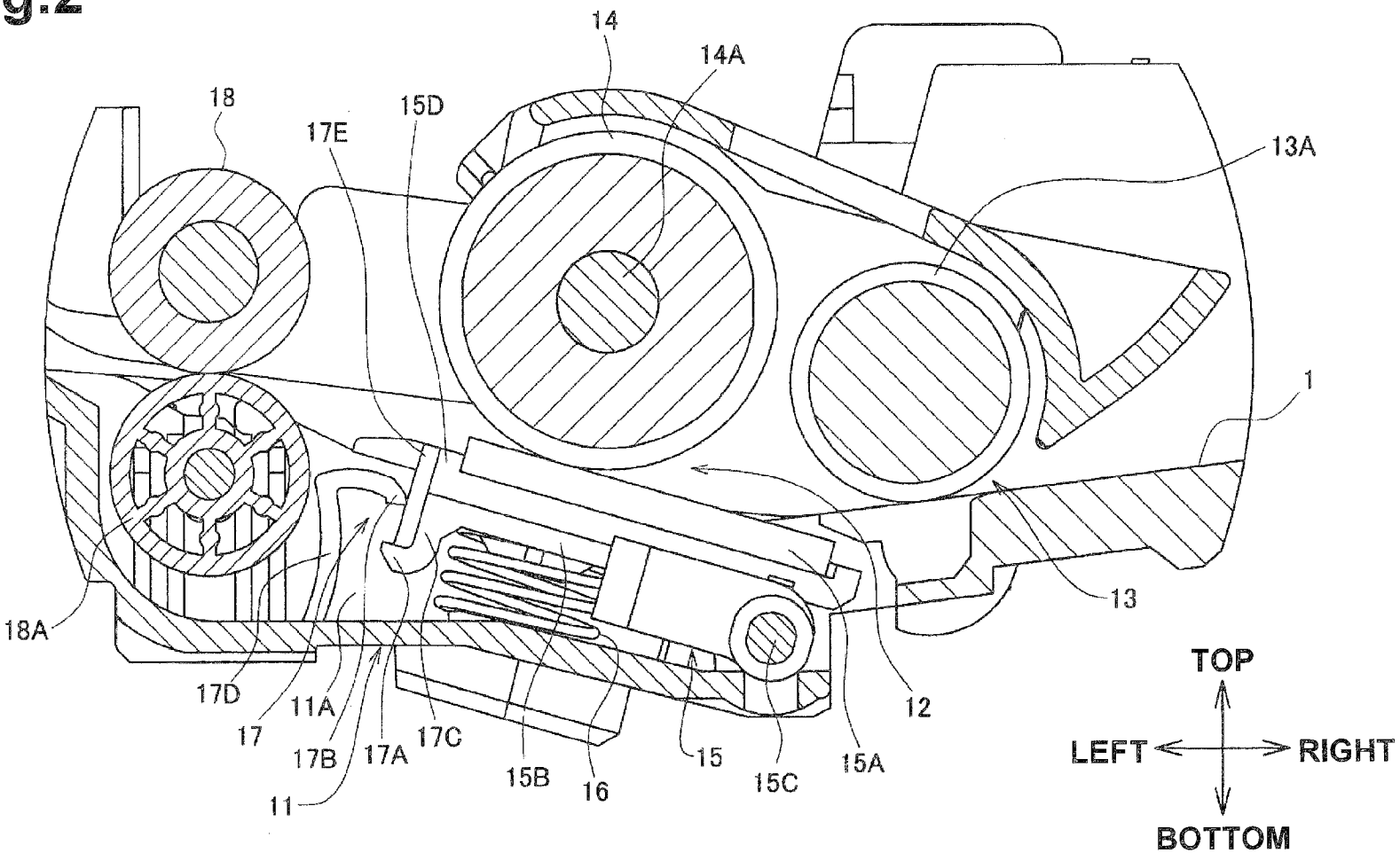
FIG. 2 is a cross sectional view of an example automatic document feeder.

As shown in FIG. 2, the ADF mechanism 10 includes a separation portion 12 and a pickup portion 13. The separation portion 12 is configured to separate a single document from documents fed from the document tray 1 and to feed the single document into the reading unit. The pickup portion 13 is disposed upstream of the separation portion 12 in the document feeding direction and is configured to draw document(s) received by the document tray 1 and feed them to the separation portion 12.

The separation portion 12 includes a separation roller 14, a pad assembly 15, and an elastic member, e.g. a spring 16. The separation roller 14 is disposed at one end side in a document stack direction where at least one document is stacked on the document tray 1. The separation roller 14 is configured to rotate in contact with a document at the one end side in the document stack direction (e.g. an upper surface of an uppermost document in this embodiment) to apply a force to the document.

The separation roller 14 is configured to rotate upon receipt of a drive force from a shaft 14A (FIG. 1). The separation roller 14 is assembled to the supporting unit 11 via the shaft 14A. Thus, the separation roller 14 is configured to rotate without changing relative position to the supporting unit 11.

The pad assembly 15 includes a separation pad 15A and a holder 15B. The separation pad 15A is disposed at the other end side, e.g., on the lower side in this embodiment, in the document stack direction, and configured to contact a document on an opposite side from the separation roller 14 and apply a resistive force to the document. The separation pad 15A may be made of any material which can obtain a specified friction resistance, e.g., silicone rubber.

The holder 15B is configured to hold the separation pad 15A. The holder 15B is fitted in a recessed portion 11A formed in the supporting unit 11. The holder 15B is pivotally assembled to the supporting unit 11, which is stationary relative to the separation roller 14. In some examples, the holder 15B is integrally formed with its pivot shafts 15C (see FIG. 7) from a resin having a high mechanical strength, e.g., polyoxymethylene (POM).

In the example embodiment, because the separation pad 15A is wholly held and fixed by the holder 15B, the separation pad 15A and the holder 15B pivot together.

Figure 3:
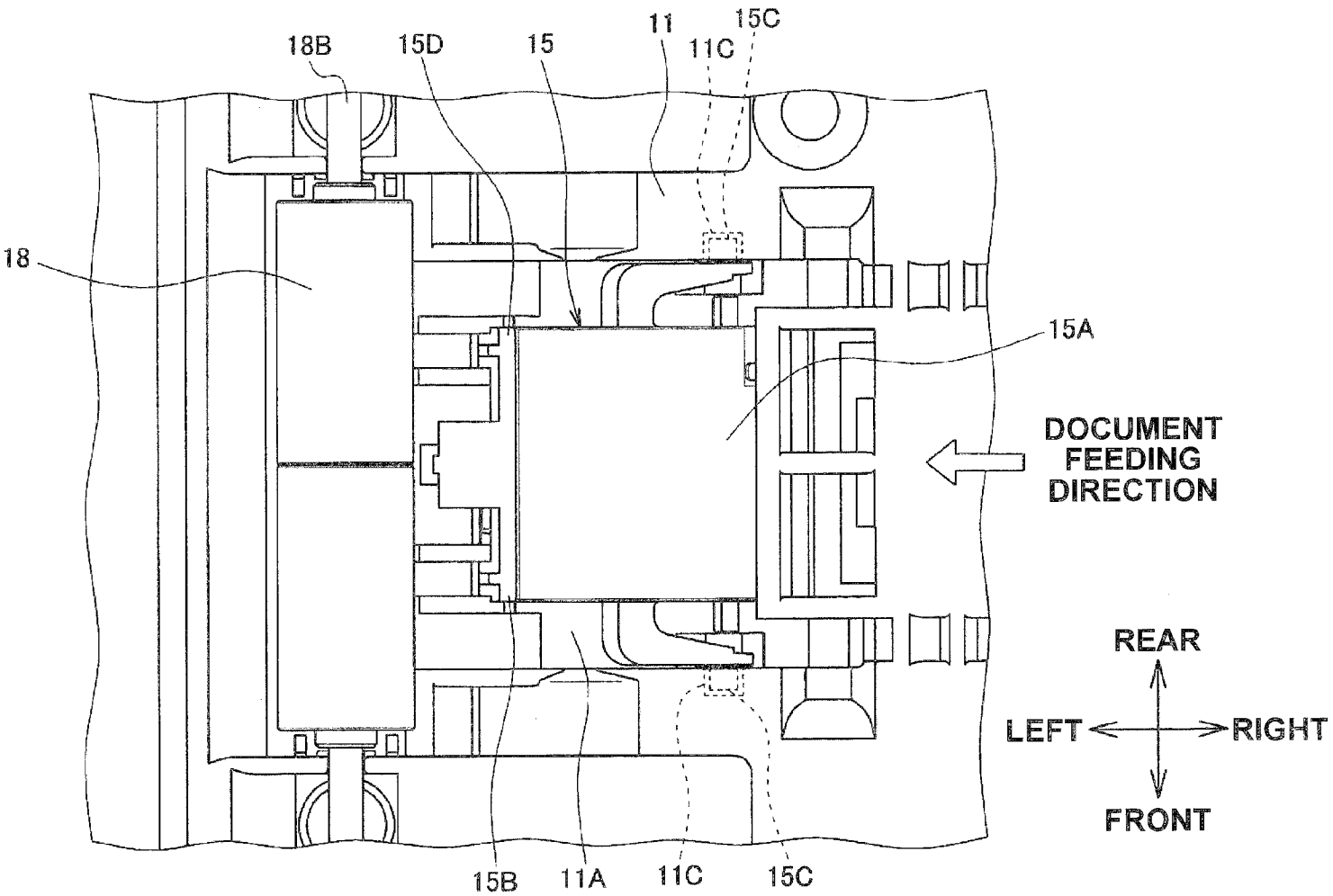
FIG. 3 is a top view of the automatic document feeder from which a separation roller is removed.

The pivot shaft 15C of the holder 15B is disposed on an upstream side of the holder 15B in the document feeding direction such that its axial direction aligns with a direction perpendicular to the document feeding direction and the document thickness direction (e.g., a front-rear direction shown in FIG. 3).

Of the ends of the pad assembly 15, an end farthest from the pivot shaft 15C along the direction perpendicular to the pivot shaft 15C (e.g., an end on a downstream side from the pivot shaft 15C in the document feeding direction), is referred to as a distal end 15D.

In one or more arrangements, the spring 16 is a coil spring disposed between the pad assembly 15 and the supporting unit 11 (e.g., a bottom portion 11B of the recessed portion 11A). The spring 16 is configured to press the pad assembly 15 toward the separation roller 14 such that the distal end 15D side of the pad assembly 15 is further separated from the supporting unit 11 (e.g., the bottom portion 11B of the recessed portion 11A).

Figure 4:
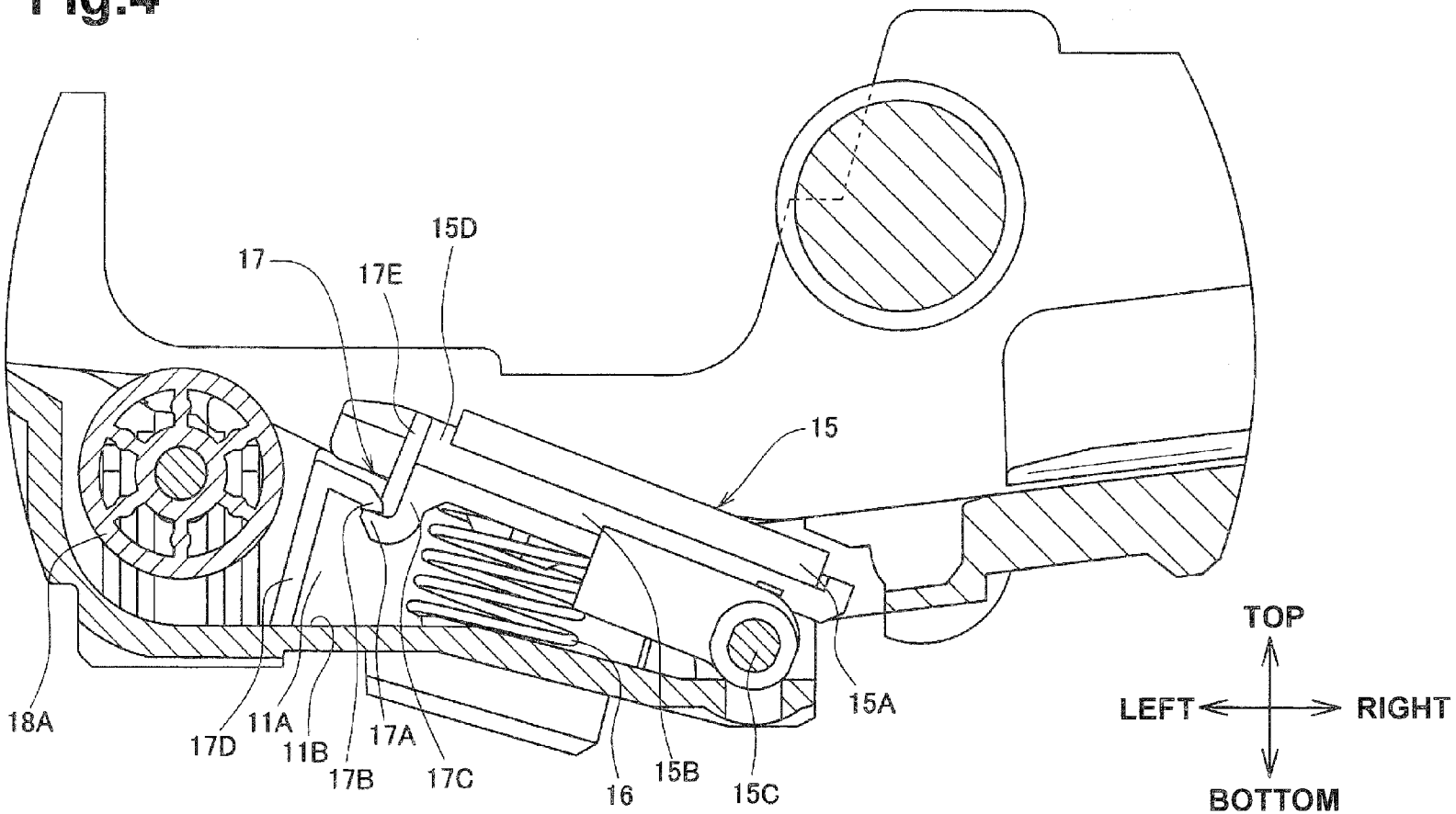
FIG. 4 is a cross sectional view of the automatic document feeder from which the separation roller is removed.

As shown in FIG. 4, when the separation roller 14 is removed from the supporting unit 11, the distal end 15D side of the pad assembly 15 is located higher than the document tray 1 (toward the separation roller 14) and higher than in a state where the separation roller 14 is attached to the supporting unit 11 (see, e.g., FIG. 2).

In this example embodiment, a regulating mechanism 17 is provided for regulating the position (e.g., height) of the distal end 15D side of the pad assembly 15 to prevent separation from the bottom portion 11B more than a specified distance. The regulating mechanism 17 includes a pad-side engaging portion 17A, as an example of a first engaging portion, provided to the holder 15B and a supporting member-side engaging portion 17B, as an example of a second engaging portion, provided to the supporting unit 11. Pivotal movement of the pad assembly 15 in a direction pointing away from the supporting unit 11 is regulated by engagement between the pad-side engaging portion 17A and the supporting member-side engaging portion 17B.

Figure 5:
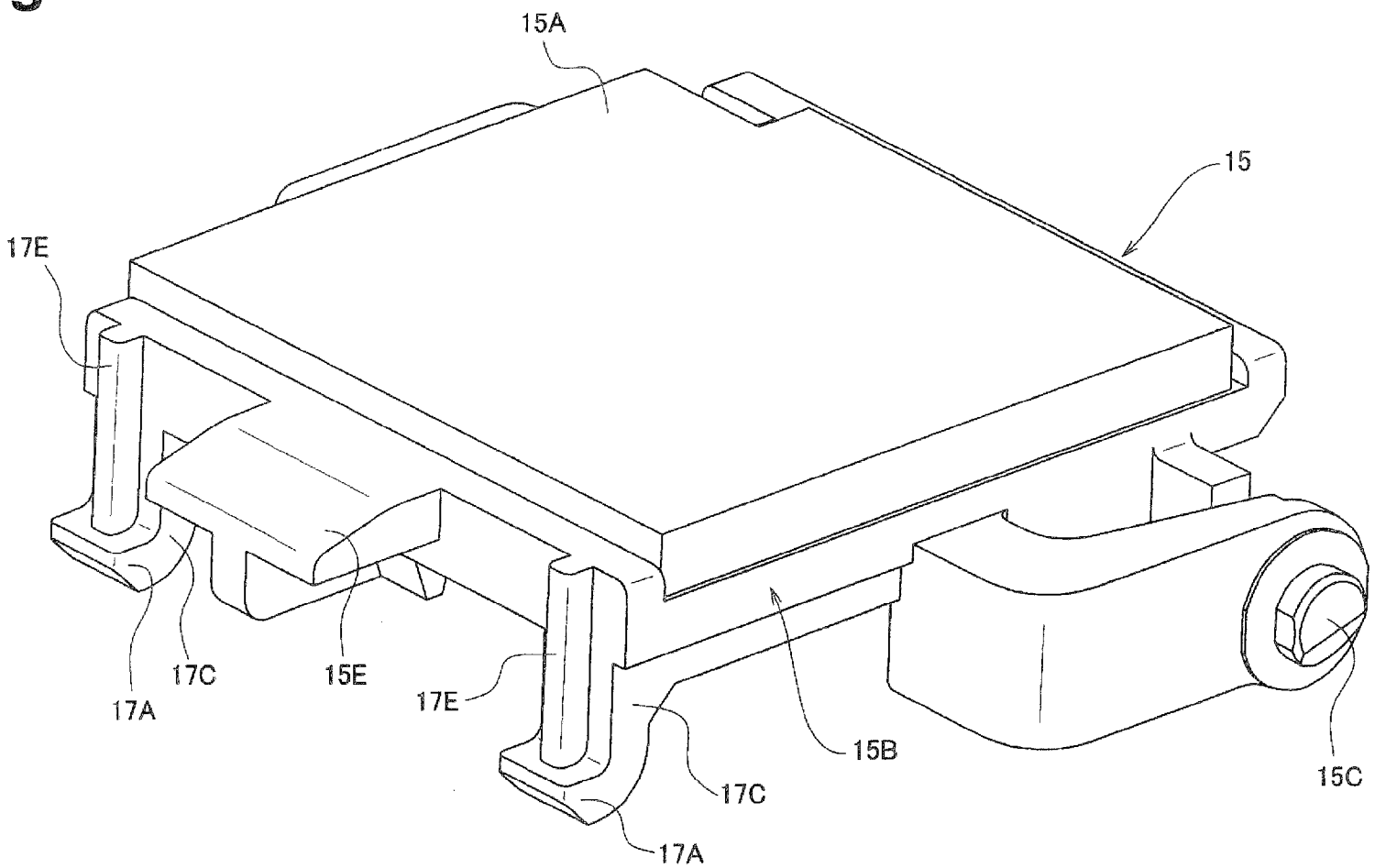
FIG. 5 is a perspective view of an example pad assembly.

The holder 15B integrally includes, on the distal end 15D side, a pad-side arm portion 17C, as an example of a first arm portion, extending toward the bottom portion 11B of the recessed portion 11A when the pad assembly 15 is assembled to the supporting unit 11. The pad-side engaging portion 17A is integrally formed at the end of the pad-side arm portion 17C in its extending direction. As shown in FIG. 5, the pad-side arm portion 17C and the pad-side engaging portion 17A are provided on each side of the holder 15B.

Figure 6:
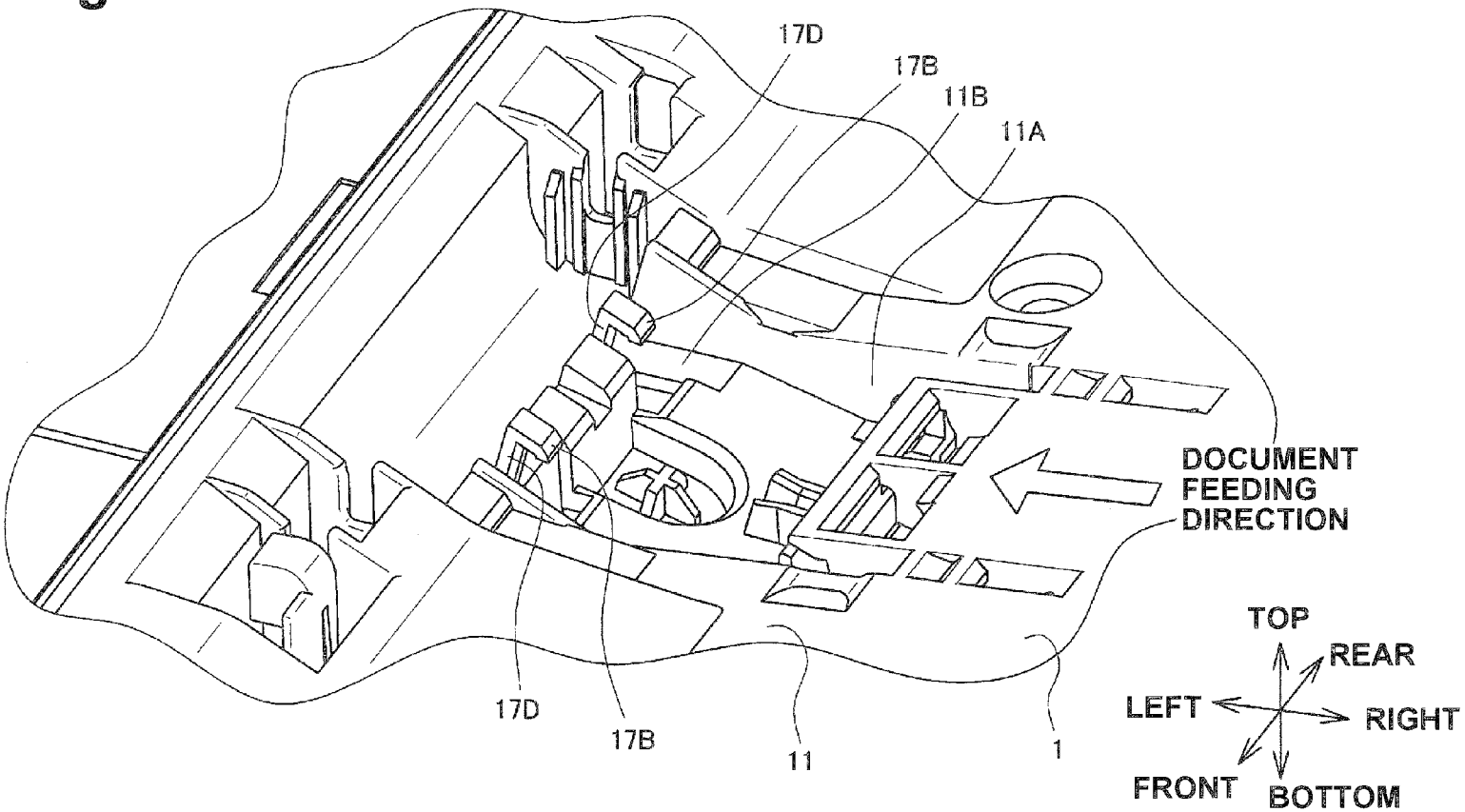
FIG. 6 is an enlarged perspective view of an example supporting member of the automatic document feeder.

As shown in FIG. 6, the supporting unit 11 integrally includes cover-side arm portions 17D, as an example of a second arm portion, located at positions facing the distal end 15D. Each of the cover-side arm portions 17D extends toward the distal end 15D of the pad assembly 15 (angled and upward in this embodiment). The supporting member-side engaging portion 17B is integrally formed at the end of each of cover-side arm portions 17D in its extending direction.

As shown in FIG. 2, the pad-side engaging portion 17A is a protrusion protruding toward the cover-side arm portion 17D, and the supporting member-side engaging portion 17B is a protrusion protruding toward the pad-side arm portion 17C.

When the engaging portions 17A and 17B engage each other, the cover-side arm portion 17D may bend and become deformed in a direction parallel to a direction pointing away from the pivot shaft 15C and toward the distal end 15D. In one example, the cover-side arm portion 17D may bend and become deformed in a direction parallel to the document feeding direction (e.g., in the left-right direction in this embodiment). The bending and deformation of the cover-side arm portion 17D may be attributable to the force acting between pad-side arm portion 17C and engaging portion 17B.

The pad-side arm portion 17C is formed with a slide portion 17E on which the end of the supporting member-side engaging portion 17B slides when the pad assembly 15 pivots. When the pad assembly 15 is pivotally displaced, the supporting member-side engaging portion 17B is pivotally displaced relative to the slide portion 17E while slidingly contacting the slide portion 17E. Thus, a friction resistance is generated at contact surfaces between the slide portion 17E and the supporting member-side engaging portion 17B.

Figure 7:
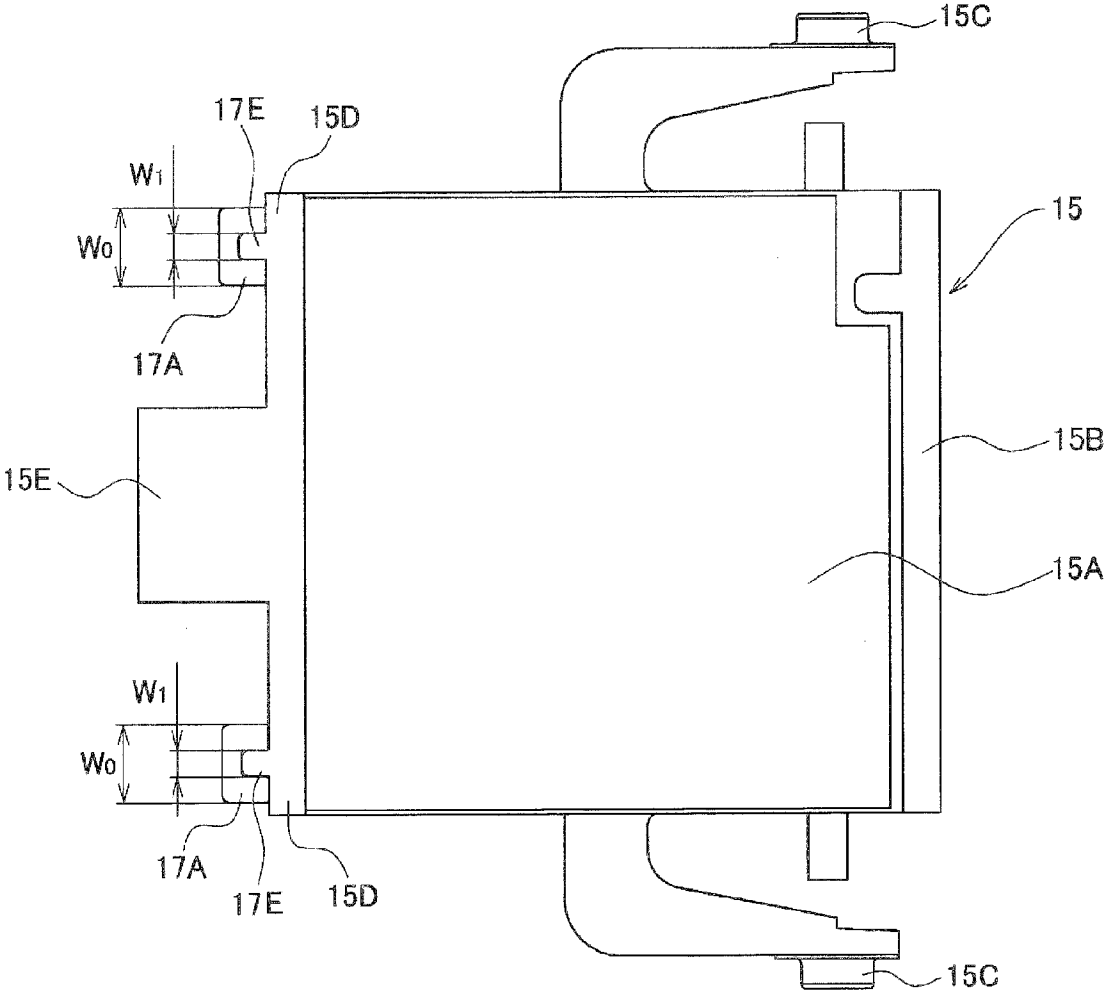
FIG. 7 is a top view of the pad assembly.

As shown in FIG. 5, each slide portion 17E includes a rib, which protrudes from the pad-side arm portion 17C toward the supporting member-side engaging portion 17B (leftward in the figure) and extends in a longitudinal direction of the pad-side arm portion 17C. As shown in FIG. 7, the slide portion 17E has a width W1 smaller than a width W0 of the pad-side arm portion 17C. The width direction is perpendicular to a direction in which the slide portion 17E protrudes and a direction in which the slide portion 17E extends. In FIG. 7, the width direction aligns with an up and down direction of the drawing sheet.

The holder 15B integrally includes, on the distal end 15D side, a gripping portion 15E, which is used for holding the pad assembly 15. The gripping portion 15E protrudes in a direction parallel to the direction in which the slide portion 17E protrudes.

As shown in FIG. 2, the pickup portion 13 includes a pickup roller 13A configured to rotate in contact with a document on the same side (e.g., same surface) as the separation roller 14 in order to apply a feeding force to the document. The pickup roller 13A receives a drive force from the shaft 14A via gears and a belt and rotates in mechanical connection with the separation roller 14.

A conveying roller 18 and a pinch roller 18A are disposed on a downstream side of the separation portion 12 in the document feeding direction. The conveying roller 18 is configured to convey a document conveyed from the separation portion 12 to a further downstream side. The pinch roller 18A is configured to press the document toward the conveying roller 18. The conveying roller 18 receives a drive force from a shaft 18B (FIG. 1) and rotates in mechanical connection with the separation roller 14.

Operations for separating and feeding documents individually (e.g., one sheet or document at a time) in the ADF mechanism will be described.

In some instances, multiple documents may be drawn from the document tray 1 to the pickup portion 13 and may subsequently go between the separation roller 14 and the separation pad 15A. The separation roller 14 and separation pad 15A are configured such that only a single document is conveyed downstream from the separation portion 12.

A document located on the separation pad 15A and one or more documents located closer to the separation pad 15A than a document contacting the separation roller 14 receive a resistive force from the separation pad 15A and are stopped from being conveyed downstream. Thus, documents stacked in the document tray 1 are conveyed individually starting from an upper most document toward the reading unit.

A change in the number of documents or thickness of documents passing between the separation roller 14 and the separation pad 15A is absorbed by the pad assembly 15 that is pivotally displaceable or moveable between a position close to the supporting unit 11 and a position away from the supporting unit 11. The amount of displacement of the pad assembly 15 each time a document is conveyed downstream may be very small. For example, the amount of displacement may be small enough to be visually imperceptible (e.g., the amount of displacement may correspond to a thickness of a single document).

Dimensional variation in the pad assembly 15 (e.g., in the holder 15B) may produce variation in the amount of deformation of the spring 16. In this embodiment, the spring modulus is made smaller by increasing the number of turns of the spring 16 to prevent a resistive force from greatly varying with the variation in the amount of deformation of the spring 16.

In this embodiment, the regulation mechanism 17 is configured to regulate the distal end 15D of the pad assembly 15 so that the distal end 15D does not separate from the supporting unit 11 more than a specified distance. As shown in FIG. 4, the regulating mechanism 17 regulates the pad assembly 15 such that the distal end 15D does not separate from the supporting unit 11 more than a specified distance. Thus, with the regulating mechanism 17, the separation roller 14 can be easily removed from and assembled to the supporting unit 11 for maintenance (e.g., without having to hold down or otherwise manipulate the distal end 15D of pad assembly 15).

To assemble the pad assembly 15, the pivot shafts 15C are inserted into holes 11C (FIG. 3) of the supporting unit 11. Then, while the gripping portion 15E is held, a force against an elastic force of the spring 16 is applied to the pad assembly 15 such that the spring 16 is compressed and the pad-side engaging portion 17A and the supporting member-side engaging portion 17B are brought to engageable positions.

The pad assembly 15 is pressed until the pad-side engaging portion 17A and the supporting member-side engaging portion 17B engage each other. As the engagement between the pad-side engaging portion 17A and the supporting member-side engaging portion 17B is maintained by the elastic force of the spring 16, the pad assembly 15 can be assembled to the supporting unit 11 without the separation roller 14 being assembled.

When the separation roller 14 is assembled after the pad assembly 15 is assembled to the supporting unit 11, the spring 16 is further compressed, and the engagement between the pad-side engaging portion 17A and the supporting member-side engaging portion 17B is released.

If the pad-side engaging portion 17A and the supporting member-side engaging portion 17B are not provided, it may be necessary to assemble the pad assembly 15 and the separation roller 14 to the supporting unit 11 at the same time, which may result in poor maintainability of the separation roller 14.

Specifically, in this case, it may be necessary to assemble the separation roller 14 while adding a force against the elastic force of the spring 16 by pressing the pad assembly 15 with the separation roller 14. When the separation roller 14 is assembled, the elastic force of the spring 16 may suddenly increase, and the spring 16 may likely come off, resulting in poor maintainability of the separation roller 14.

In this embodiment, however, as a force against the elastic force of the spring 16 is generated by the engagement between the pad-side engaging portion 17A and the supporting member-side engaging portion 17B, there is no need to press the pad assembly 15 with the separation roller 14, and thus the maintainability of the separation roller 14 can be improved.

The pad assembly 15 is likely to vibrate. Thus, when documents are individually separated with application of the resistive force to the documents, noise may come from the pad assembly 15.

However, the regulation mechanism 17 according to the embodiment includes the pad-side engaging portion 17A, which is provided to the pad assembly 15, and the supporting member-side engaging portion 17B, which is provided to the supporting unit 11 and engageable with the pad-side engaging portion 17A. Furthermore, the slide portion 17E is provided to the holder 15B, which includes the pad-side engaging portion 17A, and the supporting member-side engaging portion 17B slides on the slide portion 17E when the pad assembly 15 pivots.

With this structure, even when the pad assembly 15 vibrates, the supporting member-side engaging portion 17B slides on the slide portion 17E of the holder 15B, which includes the pad-side engaging portion 17A, and produces a friction resistance in the slide portion 17E. The friction resistance dampens the vibration of the pad assembly 15 early, thus reducing the potential for noise.

In one aspect, the slide portion 17E includes a rib, which protrudes from the pad-side arm portion 17C toward the supporting member-side engaging portion 17B and extends in the longitudinal direction of the pad-side arm portion 17C. The slide portion 17E has the width W1 smaller than the width W0 of the pad-side arm portion 17C.

With this structure, the friction resistance produced in the slide portion 17E does not excessively increase. In other words, this structure can produce appropriate friction resistance and obtain appropriate damping force.

When the arm portion 17C is formed of resin integrally with the slide portion 17E, dimensional variation in the slide portion 17E, such as variation in the protrusion dimension thereof, may be reduced as the width W1 of the slide portion 17E is smaller than the width W0 of the arm portion 17C.

This structure provides for easy maintenance of the friction resistance produced in the slide portion 17E, and the rib shape reinforces the mechanical strength of the arm portion 17C. Thus, the chance of arm portion 17C being broken can be reduced.

According to another aspect, as shown in FIG. 2, the cover-side arm portion 17D bends and becomes deformed in the direction parallel to the direction pointing away from the pivot shaft 15C and toward the distal end 15D in a state where the supporting member-side engaging portion 17B is in contact with the slide portion 17E.

With this structure, as shown in FIG. 3, the pivot shafts 15C are pressed into the holes 11C provided in the supporting unit 11 and thus the potential for noise generated by periodic or aperiodic contact between the pivot shafts 15C and the holes 11C can be reduced.

According to another aspect, the gripping portion 15E, which is used for holding the pad assembly 15, is disposed on the distal end 15D side of the pad assembly 15. The pad assembly 15 can be held at the gripping portion 15E without contacting the separation pad 15A, such that the separation pad 15A can be kept from being soiled.

The illustrative embodiment shows, but the disclosure is not limited to, that the regulation mechanism 17 is provided on the distal end 15D side of the pad assembly 15. The regulation mechanism 17 may be provided on a side closer to the pivot shaft 15C than the distal end 15D.

The illustrative embodiment shows, but the disclosure is not limited to, the slide portion 17E being integrally formed on the pad-side arm portion 17C of the regulation mechanism 17. For example, the slide portion 17E may be provided separately from the pad-side arm portion 17C. Similarly, a member sliding on the slide portion 17E, e.g., the supporting member-side engaging portion 17B, may be provided as a separate component.

The illustrative embodiment shows, but the disclosure is not limited to, the slide portion 17E being disposed on the pad-side arm portion 17C. In another example, the slide portion 17E may be disposed on the cover-side arm portion 17D, such that the slide portion 17E and the pad-side engaging portion 17A may be configured to slidingly contact each other.

The illustrative embodiment shows, but the disclosure is not limited to, a direction of the normal force acting on the sliding portion 17E (e.g., a direction in which the cover-side arm portion 17D presses) being parallel to a direction pointing away from the pivot shaft 15C and toward the distal end 15D.

The illustrative embodiment shows, but the disclosure is not limited to, the separation roller 14 being disposed at an upper end in the stack direction and the separation pad 15A being disposed at a lower end in the stack direction. For example, the separation roller 14 may instead be disposed at the lower end in the stack direction and the separation pad 15A may be disposed at the upper end in the stack direction.

The illustrative embodiment shows, but the disclosure is not limited to, the pivot shafts 15C being engaged in the holes 11C provided in the supporting unit 11. In one arrangement, the pivot shafts 15C pivotally supporting the pad assembly 15 may be disposed in the supporting unit 11 and the holes 11C may be provided in the holder 15B of the pad assembly 15.

The illustrative embodiment shows, but the disclosure is not limited to, the slide portion 17E having a width W1 smaller than a width W0 of the pad-side arm portion 17C. For example, the width W1 of the slide portion 17E may be greater than the width W0 of the arm portion 17C.

The illustrative embodiment shows, but the disclosure is not limited to, application of the aspects described herein to the ADF mechanism 10. For example, one or more aspects described herein may be applied to a sheet supply device among other devices.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. A sheet feeding apparatus configured to individually feed sheets stacked in a stacking direction, the sheet feeding apparatus comprising:

a supporting unit;

a separation roller configured to rotate in contact with a sheet of the stacked sheets to apply a feeding force to the sheet;

a pad assembly configured to pivot about a pivot axis between a first position and a second position, wherein at least a portion of the pad assembly is closer to the supporting unit in the first position than in the second position, wherein the supporting unit is stationary relative to the separation roller, the pad assembly including:

a separation pad with a surface disposed facing the separation roller and configured to contact a sheet of the stacked sheets to apply a resistive force to the sheet;

a holder holding the separation pad, the holder being pivotally attached to the supporting unit;

a first engaging portion; and a slide portion having a rib; and an elastic member configured to press the pad assembly toward the separation roller, wherein the supporting unit includes an arm portion including a second engaging portion, wherein the first engaging portion of the pad assembly and the second engaging portion of the supporting unit are configured to engage each other at an engagement position to restrict the pad assembly from separating from the supporting unit more than a specified distance when the separation roller is separated from the separation pad wherein the engagement position is disposed farther from the pivot axis of the pad assembly, in a direction substantially perpendicular to the pivot axis of the pad assembly and substantially parallel to the surface of the separation pad facing the separation roller, than any portion of the separation pad, and wherein the second engaging portion protrudes from the arm portion of the supporting unit toward the first engaging portion and is configured to, when the pad assembly pivots, slides on the rib of the slide portion of the pad assembly and urge the pad assembly toward the pivot axis, wherein the rib protrudes toward the second engaging portion and extends in a direction where the second engaging portion slides.

2. The sheet feeding apparatus according to claim 1, wherein the supporting unit supports a roller disposed downstream of the second engaging portion of the supporting unit in a direction in which the sheets are fed.

3. The sheet feeding apparatus according to claim 1, wherein the pad assembly further includes, on a distal end thereof, an arm portion including the first engaging portion at an end of the arm portion of the pad assembly, wherein the arm portion of the pad assembly is different from the arm portion of the supporting unit.

4. The sheet feeding apparatus according to claim 3, wherein the slide portion of the pad assembly is provided to the arm portion of the pad assembly.

5. The sheet feeding apparatus according to claim 3, wherein the second engaging portion is disposed at an end of the arm portion of the supporting unit, and wherein, when the separation roller contacts the separation pad, the arm portion of the supporting unit bends and becomes deformed in a direction pointing away from the pivot axis of the pad assembly.

6. The sheet feeding apparatus according to claim 3, wherein the rib of the slide portion of the pad assembly protrudes from the arm portion of the pad assembly toward the second engaging portion of the supporting unit and extends along a longitudinal direction of the arm portion of the pad assembly, and wherein the slide portion of the pad assembly has a width smaller than a width of the arm portion of the pad assembly, wherein the width of the slide portion and the width of the arm portion of the pad assembly are defined as being perpendicular to both of a direction in which the rib of the slide portion protrudes and a direction in which the rib of the slide portion extends.

7. The sheet feeding apparatus according to claim 1, wherein, when the separation roller contacts the separation pad, the first engaging portion of the pad assembly is separated from the second engaging portion of the supporting unit and the second engaging portion of the supporting unit contacts the rib of the slide portion of the pad assembly.

8. The sheet feeding apparatus according to claim 1, wherein the second engaging portion is disposed at an end of the arm portion of the supporting unit.

9. The sheet feeding apparatus according to claim 1, wherein the first engaging portion of the pad assembly protrudes from a distal end of the pad assembly in a direction pointing away from the pivot axis of the pad assembly.

10. The sheet feeding apparatus according to claim 1, wherein, when the separation roller is separated from the separation pad, the engaging portion of the pad assembly contacts the second engaging portion of the arm portion of the supporting unit.

11. The sheet feeding apparatus according to claim 10, wherein when the separation roller is separated from the separation pad, the first engaging portion of the pad assembly is configured to engage the second engaging portion of the supporting unit from below the second engaging portion thereof.

12. The sheet feeding apparatus according to claim 1, wherein the elastic member includes a spring.

13. The sheet feeding apparatus according to claim 1, wherein the slide portion of the pad assembly is disposed at a position farther from the pivot axis of the pad assembly, in the direction substantially perpendicular to the pivot axis of the pad assembly, than a distal end of the separation pad.

14. A sheet feeding apparatus configured to individually feed sheets stacked in a stacking direction, the sheet feeding apparatus comprising:

a supporting unit;

a separation roller configured to rotate in contact with a sheet of the stacked sheets to apply a feeding force to the sheet;

a pad assembly configured to pivot about a pivot axis between a first position and a second position, wherein at least a portion of the pad assembly is closer to the supporting unit in the first position than in the second position, wherein the supporting unit is stationary relative to the separation roller, the pad assembly including:

a separation pad disposed facing the separation roller and configured to contact a sheet of the stacked sheets to apply a resistive force to the sheet;

a holder holding the separation pad, the holder being pivotally attached to the supporting unit;

a first engaging portion disposed on a distal end of the pad assembly relative to the pivot axis of the pad assembly;

a first arm portion, wherein the first arm portion is disposed on the distal end of the pad assembly and wherein the first engaging portion is disposed at an end of the first arm portion; and a slide portion; and an elastic member configured to press the pad assembly toward the separation roller, wherein the supporting unit includes a second engaging portion, wherein the first engaging portion of the pad assembly and the second engaging portion of the supporting unit are configured to engage each other to restrict the pad assembly from separating from the supporting unit more than a specified distance when the separation roller is separated from the separation pad, wherein the second engaging portion of the supporting unit is configured to slide on the slide portion of the pad assembly when the pad assembly pivots, and wherein the slide portion of the pad assembly includes a rib, the rib protruding from the first arm portion of the pad assembly toward the second engaging portion of the supporting unit and extending along a longitudinal direction of the first arm portion, wherein the slide portion has a width smaller than a width of the first arm portion, and wherein the width of the slide portion and the width of the first arm portion are defined as being perpendicular to both of a direction in which the slide portion protrudes and a direction in which the slide portion extends.

* * * * *